United States Patent [19]

Fukasawa et al.

[11] 4,246,552

[45] Jan. 20, 1981

[54] STRIPLINE CIRCULATOR WHEREIN EACH INNER CONDUCTOR IS V-SHAPED

[75] Inventors: Atsushi Fukasawa; Ryoichi Miyamoto; Takuro Sato, all of Tokyo, Japan

[73] Assignee: Oki Electric Industry Co., Ltd., Tokyo, Japan

[21] Appl. No.: 7,189

[22] Filed: Jan. 29, 1979

[30] Foreign Application Priority Data

Feb. 3, 1978 [JP] Japan ..... 53-10531

[51] Int. Cl.[3] ..... H01P 1/387

[52] U.S. Cl. ..... 333/1.1; 333/238

[58] Field of Search ..... 333/1.1

[56] References Cited

U.S. PATENT DOCUMENTS 3,335,374 8/1967 Konishi ..... 333/1.1

3,510,804 5/1970 Hashimoto et al. ..... 333/1.1

OTHER PUBLICATIONS

Konishi, *Lumped Element Y-Circulator,* IEEE Trans. on MTT, vol. MTT-13, No. 6, Nov. 1965.

*Primary Examiner*—Paul L. Gensler

*Attorney, Agent, or Firm*—Frailey & Ratner

[57] ABSTRACT

A circulator comprises a cylindrical conductor housing, a disc shaped magnetic component mounted in said housing, three V-shaped inner conductors having two linear arms provided on the surface of said magnetic component, said inner conductors conjoining substantially at the center of said surface maintaining a 120-degree angle to each other, the open end of said V-shaped inner conductor being connected to the housing, and the other end of said V-shaped inner conductor being connected to an external strip line.

4 Claims, 29 Drawing Figures

FIG. 7(A)
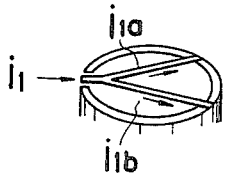
FIG. 7(B)
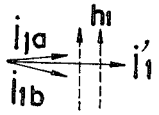
FIG. 8
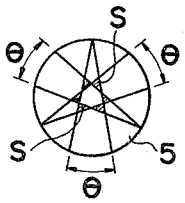
FIG. 9(B)
FIG. 9(A)
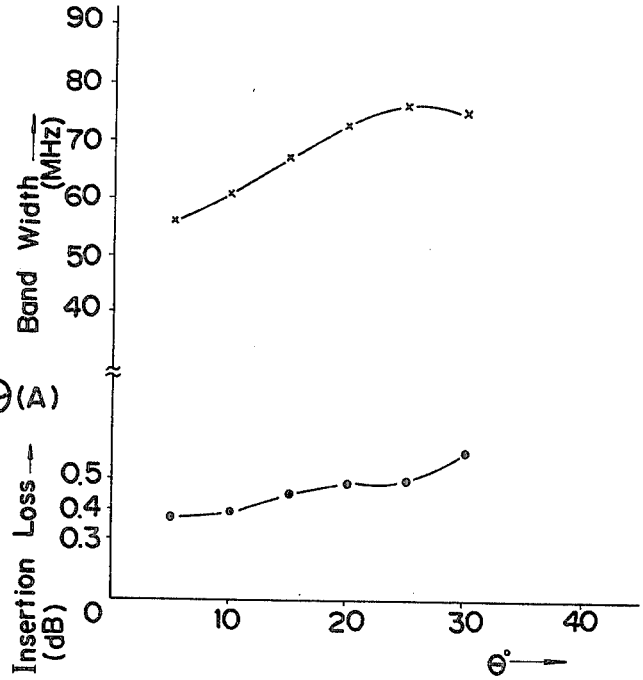

STRIPLINE CIRCULATOR WHEREIN EACH INNER CONDUCTOR IS V-SHAPED

BACKGROUND OF THE INVENTION

The present invention relates to the structure of a strip line type circulator with excellent electric characteristics appropriate for mass production.

FIG. 1 (A) is a principle drawing illustrating the 3 port symmetry (Y shape) junction. The Y shaped symmetry junction is obtained after the 3 coaxial transmission lines 1*a*, 2*a*, and 3*a* have been converted to the strip lines and are then conjoined in a plane mutually maintaining the 120° angle. At the junction, magnetic components 5 are inserted between the inner conductors 1, 2, and 3 and the earth conductor 4 which also functions as a housing. The ends of 1, 2, and 3 are shorted with the earth conductor 4. The (microwave) circulator is obtained by applying a static magnetic field to the magnetic component 5 from outside and at the same time by adding capacity to the center of or the peripheral exterior of the junction. At this level, the inner conductor 1, 2, and 3 at the center where they conjoined, are supposed to be mutually insulated.

When a high frequency input signal is applied to the terminal 1*a* in FIG. 1 (A), electric current $i_1$ flows to the inner conductor 1 at the junction as illustrated in FIG. 1 (B), resulting in generation of a high frequency magnetic field $h_1$. The magnetic component 5 mounted on the junction turns $h_1$ by 120° within the plane of the junction and generates high frequency magnetic field $h_3$. The $h_3$ generates high frequency current $i_3$ in the inner conductor 3. The $i_3$ induces a high frequency output signal to the terminal 3. On the other hand, if the functions, etc. of the magnetic component are adjusted beforehand, the direction of the composed vector $h_2$ of the high frequency magnetic fields $h_1$ and $h_3$ becomes, as illustrated in FIG. 1 (B), parallel to the inner conductor 2, while the current $i_2$ induced by $h_2$ perpendicularly intersects the inner conductor 2, to which the current cannot flow. That is, the input signal into the terminal 1*a* is transferred to the terminal 3*a* but not to the terminal 2*a*. 2*a* is called an isolation terminal. It is necessary to adjust the external magnetic field by a magnet, etc., so that the phase of the vector of $h_1$ and $h_3$ may be correctly maintained as illustrated in FIG. 1 (B). And also, it is necessary to add capacitors, arranged in series or in parallel, to the terminals 1*a*, 2*a*, and 3*a* on the exterior of the junction. From the above description, it may be understood that the circulator function can be obtained by close interactions (without leakage) with respect to correct vector relations among the 4 components, viz. the 3 inner conductors, which are arranged at an angle of 120° to one another in the plane of the junction, and the magnetic component. With respect to the vector relations in FIG. 1 (B), it is desirable that all conditions are satisfactory throughout the area at the junction, within the magnetic component, in particular. In order to attain this, it is necessary to restrain disorder, such as space distortion of the high frequency magnetic field vector within the magnetic component and its periphery as well as leakage, at the minimum level. A theoretical drawing is given in FIGS. 2A and 2B to illustrate a concentrated constant type circulator proposed to obtain a particularly small-sized circulator. The circulator in FIGS. 2A and 2B has been disclosed in Japanese Patent publication (after examination) No. 15058/66 corresponding to U.S. Pat. No. 3,286,201.

The proposition described that (1) this circulator incorporates the inductors 6, 7, and 8 as the inner conductors of the junction; (2) incorporates concentrated constant capacitors between the transmission lines and the inductors; (3) maintains the magnetic field applied to the magnetic component maintained at the level of "above resonance" function which is higher than the magnetic resonance; (4) and further, it employs Y shaped wiring as a means of connecting the 3 inductors 6, 7, and 8 (the Δ shape is also described). Thus, it is equipped with all the fundamental technological requirements for a concentrated constant small sized circulator. At the same time, there was a proposition where a substrate having a conductor on the surface of the same is utilized for obtaining the inductance (for instance, Japanese Patent publication after examination No. 11290/66, and No. 11291/66).

In contrast with the inductor in FIGS. 2A and 2B, a proposition (Japanese Patent publication after examination No. 4088/67) was made, where the inner conductor of the strip line of the junction is split into two or more multiple parallel lines as illustrated in FIGS. 3(A) through 3(E). Examples of the configuration of the inner conductor are illustrated in FIGS. 3(A), 3(B), and 3(C), and the structure of the junction in FIG. 3(D). If the inner conductor is made broad or wide as indicated in FIG. 1(A), the 3 inner conductors shelter one another, while a capacity independent of circulator function is generated between the inner conductors. This is not practicable.

The most used type in the VHF, UHF bands at present is the two parallel strip line type. However, when the frequencies used in such a type are high, circulator is small-sized but requires high electric current, the two-parallel-line strip line type has 2 defects. One of the defects is related to the electrical characteristics. Examples of the inner conductor of the two-parallel-line strip line are illustrated in FIGS. 3(A), 3(B), and 3(C). If the condition of the current vector is studied, it can be noted that at the point A in FIG. 3(E), rectangular current components $i_{1a}$, and $i_{1b}$ which are undesirable for the function of the circulator are generated. These current components generate magnetic field components $h_{1a}$, $h_{1b}$ within the magnetic component around point A, thus deteriorating the electrical characteristics of the circulator. The disorder of the electro-magnetic field at point A grows larger as the operational frequencies become higher, which in turn increases the circulator loss, narrowing the band width. Another defect of the parallel arm circulator shown in FIGS. 3(A) through 3(F) lies in the difficulties in the assembly of the inner conductor of the junction as well as the production of the earth conductor which also doubles as the housing. In order to avoid this, a proposition (Japanese Patent publication after examination No. 19010/74) was made involving a method where printed circuit boards with through-hole connections are used, and a method (Japanese Patent publication after examination No. 12709/75) was proposed where the circular inner conductors (A), (B), etc., are used as illustrated in FIGS. 4(A) and 4(B) and assembled as depicted in FIG. 4(C). However, the former method is not practicable, in consideration of the fact that most of the circulators are used for the protection of high power transistors for VHF, UHF bands and for reducing spurious resonance resulting from non-linearity of the high power transistors. That is, the conductors of the printed circuit being very thin, their copper loss is great, resulting in an increase in heat generated therefrom and a vicious cycle begins. For this reason, a thick conductor pattern is currently used, which makes manual production imperative, and also makes the circulator one of the most costly components incorporated in communications equipment.

With respect to the latter (Japanese Patent publication after examination 12709/75) the inner conductors of the strip line of the junction are circular as depicted in FIG. 4(A) or 4(B) which are assembled as illustrated in FIG. 4(C). With this configuration, the number of terminals of the inner conductors are three for both the lines and the short circuit ends, while the structure of the junction case, serving as the earth conductor as well, and a junction which can be readily assembled are appropriate for mass production. However, based on electrical properties, generation of modes unnecessary for the function of the circulator at points A and A' cannot be prevented, since the current of the inner conductor as illustrated in FIGS. 4(D) and 4(E) is very similar to the rectangular components of current vector of FIG. 3(F) in the close vicinity of point A or point B.

SUMMARY OF THE INVENTION

Therefore, the present invention improves the above shortcomings of conventional circulators. The object is to prevent disorder of the electro-magnetic waves at the terminal ends of the circulator junction and at the same time to present a structure which makes simplified high precision assembly possible. In order to attain the above objects, the present invention has the following characteristic feature, where the configuration of the inner conductor at the junction of the circulator is such that at least 2 arms with a predetermined branch angle are of radial shape and that the open end of each arm is shorted-circuited to the housing which doubles as an earth conductor. In the case of 2 arms, the configuration of the internal conductor becomes approximately a V shape.

DETAILED DESCRIPTION OF THE DRAWINGS

Figure 1A:
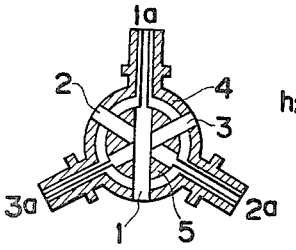
FIG. 1(A) PRIOR ART
Figure 1B:
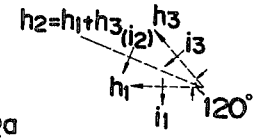
FIG. 1(B) PRIOR ART
Figure 2A:
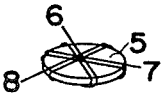
FIG. 2(A) PRIOR ART
Figure 2B:
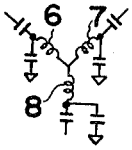
FIG. 2(B) PRIOR ART
Figure 3:
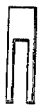
FIG. 3 (A) PRIOR ART
Figure 3B:
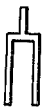
FIG. 3(B) PRIOR ART
Figure 3:
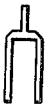
FIG. 3 (C) PRIOR ART
Figure 3:
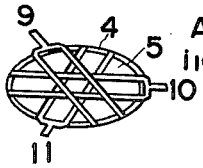
FIG. 3 (D) PRIOR ART
Figure 3:
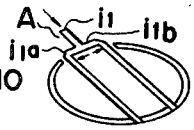
FIG. 3 (E) PRIOR ART
Figure 3:
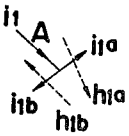
FIG. 3 (F) PRIOR ART
Figure 4:
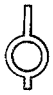
FIG. 4 (A) PRIOR ART
Figure 4:
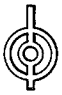
FIG. 4 (B) PRIOR ART
Figure 4C:
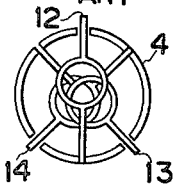
FIG. 4(C) PRIOR ART
Figure 4D:
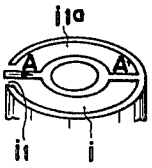
FIG. 4(D) PRIOR ART
Figure 4E:
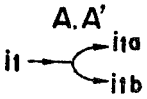
FIG. 4(E) PRIOR ART
Figure 5:
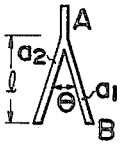
Figure 6:
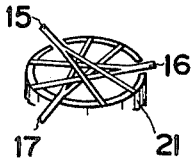
Figure 10:
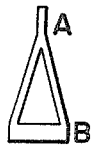
Figure 11:
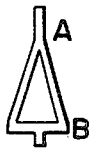
Figure 12:
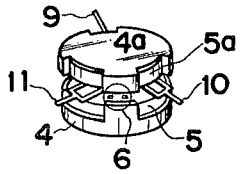
FIG. 12 PRIOR ART
Figure 13A:
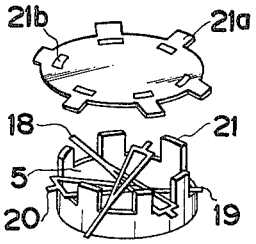
Figure 13B:
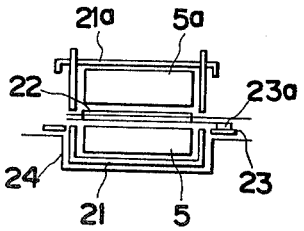
Figure 14:
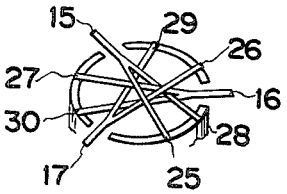
Figure 15:
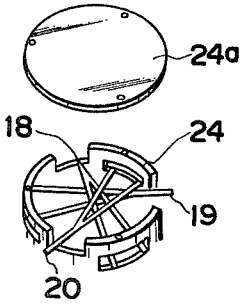

The foregoing and other objects, features, and attendant advantages of the present invention will be appreciated as the same become better understood by means of the following description and accompanying drawings wherein;

FIG. 1(A) and FIG. 1(B) are explanatory drawings of the operational principle of a prior strip line type circulator, FIG. 2(A) and FIG. 2(B) are explanatory drawings of the operational principle of a prior lumped constant type circulator having an inductor, FIGS. 3(A) through 3(F) are explanatory drawings of a prior parallel arm type circulator, FIGS. 4(A) through 4(E) are explanatory drawings of another prior circulator, FIG. 5 shows the structure of the element of the inner conductor of the present circulator, FIG. 6 is the assembled inner conductor according to the present invention, FIG. 7(A), FIG. 7(B) and FIG. 8 are explanatory drawings of the operation of the present circulator, FIG. 9(A) and FIG. 9(B) show the curve of the characteristics of the present circulator, FIG. 10 and FIG. 11 are the element of the inner conductor of the circulator for showing the effect of the present invention, FIG. 12 is the structure of the assembled circulator of a prior art, FIG. 13(A) and FIG. 13(B) show the structure of the assembled circulator of the present invention, FIG. 14 shows another structure of the assembled circulator according to the present invention, and FIG. 15 shows still another structure of the assembled circulator according to the present invention.

DESCRIPTION OF THE PREFERRED EMBODIMENTS

FIG. 5 illustrates an embodiment of the present invention giving a configuration at the junction of the strip line inner conductor. The inner conductor is approximately of V shape with arms $a_1$ and $a_2$ opening at an angle of $\theta°$. The perpendicular distance between the joint A of the 2 arms and the extreme end B of the arms is (l). The distance (l) is equal to the diameter of the magnetic disc. Since the arms are open at an angle smaller than 90° or $\theta$, around the point A the direction of the current vector does not change radically and the disorder of the electro-magnetic field is prevented. Further, since the inner conductor is of V shape, one of the arms of the 3 inner conductors can conjoin simultaneously in the small area (the triangular shaded area S in FIG. 8). At the same time, this small area can be distributed effectively within the plane of the junction. The inner conductors 15, 16, 17, each of which is shown in FIG. 5 are assembled as illustrated in FIG. 6. The V shaped open ends are electrically connected to the earth conductor 21 which serves as a housing as well.

As described above, the condition for realization of a good circulator function is conjoining of the 3 vectors of high frequency magnetic fields $h_1$, $h_2$, and $h_3$ within a plane at a correct angle and phase without leakage. FIGS. 7A and 7B illustrate the behavior of the current $i_1$ and the magnetic vector $h_1$ along the inner conductor. As illustrated in this Figure, the vector composed of the branched current $i_{1a}$, $i_{1b}$, of $i_1$ becomes $i_1'$. The magnetic vector $h_1$ created by the $i_1'$ has now become a parallel linear vector and is at right angles to $i_1$. That is, no unnecessary vector is generated.

FIG. 8 provides the picture of the 3 inner conductors intersecting on the surface of the magnetic component. With respect to the 3 inner conductors for generating the 3 magnetic vectors $h_1$, $h_2$, $h_3$, of the two arms of the V shaped conductor, either the left or right arm conjoins. The parts where the arms conjoin are the 6 triangular shaded spots S and one central hexagonal part. The 6 intersecting parts S are not mere dots but are triangular areas. As the angle $\theta$ in FIG. 5 increases from 0°, the 6 intersections S shift in the peripheral direction from the center point within a plane of the magnetic component 5. The effect of generating magnetic vectors $h_1$, $h_2$, $h_3$, through satisfactory conjoining of the current of the intersections of the 3 inner conductors and the magnetic component 5, changes with variation in the angle $\theta$. There exists an optimum angle $\theta$ where the effect is the best.

FIG. 9(A) illustrates the relationship between the angle $\theta$ and the insertion loss of the 900 MHz band circulator, where the inner conductors in FIG. 5 have been employed, and FIG. 9(B) shows the relationship between the angle $\theta$ and the bandwidth (called 20 dB isolation bandwidth), where the level of high frequency leak to the isolation terminal is decreased by 20 dB. The example in FIG. 9 indicates that the optimum angle $\theta$ is around 15°-25°.

An experiment was undertaken in order to test the effect of the V shaped inner conductor. Contrary to the above result where the arrangement was correctly made as depicted in FIG. 6, a test was conducted inversely with the configuration in FIG. 10 and FIG. 11, where the point A was short-circuited and the point B was connected to the line. The result showed that the 20 dB isolation bandwidth was less than 70% of the case with correct arrangement. This explains that the reflection at the point A in FIG. 5 is effectively prevented. Also, with respect to 900 MHz, an experiment to compare the arrangement in FIG. 6, (the width of the inner conductor being 1 mm and the V shape of $\theta$ being 15°), with the arrangement in FIG. 3(D) (the width of 1 mm and an interval of 2.5 mm) was made. The result was that the 20 dB isolation bandwidth of the former was 10-15% wider. The insertion loss was about the same.

The strip line type circulator, incorporating the V shaped inner conductor according to the present invention illustrated in FIG. 5, introduces a structure simpler than the conventional art. Therefore, mass production is greatly facilitated. FIG. 12 illustrates an example of the structure of the high power small-sized circulator with the conventional 2 parallel line inner conductor. In the interior of the junction case 4, 4*a* which also plays the role of earth conductor, the magnetic component 5, 5*a* and inner conductors 9, 10, 11 are accommodated. As can be identified from FIG. 3(D), the design of the case 4, 4*a* for the parallel inner conductors is extremely difficult. Therefore, as illustrated in FIG. 12, the length of the part 6 in FIG. 12 is extended and is wholly soldered together with the ends of the inner conductors 9, 10, and 11. With this structure, it is extremely difficult to assemble all the components correctly with respect to their positions and mutual angles. So far, assembly of a lot of 200-300 units of such a small component as illustrated in FIG. 12 required 40 minutes—60 minutes, which could hardly be called mass production. If the assembly is not perfect, electrical adjustment takes a long time, which adversely affects mass production.

If the V shaped inner conductor based on the present invention is employed, the structure of the junction case, in particular, which is also an earth conductor, can be simplified. FIGS. 13(A) and 13(B) illustrate an embodiment relating to the structure of the case which is also an earth conductor incorporating the inner conductors under the present invention. The case 21 also used as earth conductor is provided with a groove so that it will not short-circuit with the inner conductors 18, 19, and 20. The cap 21*a* has holes to let 21 pass them through. The edge of 21*a* can be bent. The circumference of the hole 21*b* of the cap 21*a* can be soldered if necessary after completion of all the assembly work. The structure as illustrated in FIGS. 13(A) and 13(B) makes mass production possible following the process as follows:

The magnetic disc 5 is placed in the case 21. The inner conductors are mutually insulated and are set in place so that they are arranged at an intersecting angle of 120°. The insulators are thermo-coupled and form one unified body of inner conductor 22. The magnetic disc 5*a* is then placed and the cap 21*a* is put on. Assembly process having been done in this order, the conductor island 23*a* of the printed circuit 23, provided on the exterior of the case 21, and one end of the inner conductor are soldered together, etc. The substrate 23 and the case 21 are fixed to the chassis 24 with fasteners.

FIG. 14 illustrates another embodiment of the present invention. This is different from FIG. 6 in that 2 V shaped arms of the inner conductors 15, 16, and 17 intersect one another. Electrical unbalance is reduced by placing each of the V shaped arms so that they lie one upon another orderly so that all the inner conductors will have equal configuration from the reference numeral 25 through 30 in that order.

FIG. 15 illustrates another embodiment of the present invention. This relates to the structure of the case which is also an earth conductor. In this embodiment, the cap 24*a* can be fastened to the case 24 with a screw which further facilitates assembly work.

The present invention incorporates V-shape branched inner conductors. Electrically, this reduces reflection of electro-magnetic wave at the ends of the circulator junction. Further, in the junction, by maintaining the intersection configuration of satisfactory magnetic vector, the limit of the frequencies used by the strip line type lumped constant circulator can be expanded larger than heretofore. Furthermore, the structure of the junction case can be readily simplified. This makes it possible to supply low priced yet high quality circulators in volume. Industrially, the new circulators can be used in radios for mounting on automobiles. Thus, the new circulator significantly contributes to low cost mass production.

From the foregoing it will now be apparent that a new and improved circulator has been found. It should be understood of course that the embodiments disclosed are merely illustrative and are not intended to limit the scope of the invention. Reference should be made to the appended claims, therefore, rather than thee specification as indicating the scope of the invention.

What is claimed is:

1. A strip line type circulator comprising a cylindrical conductor housing, a disc shaped gyromagnetic component mounted in said housing, three inner elongated conductors provided on the surface of said gyromagnetic component, said inner conductors conjoining substantially at the center of said surface maintaining a 120 degree angle to each other, and means for applying a magnetic field to said gyromagnetic component, characterized in that each inner conductor is V-shaped having two linear arms with a predetermined branch angle less than 90 degrees, the open end of the V-shaped inner conductor is connected to the housing, and the other end of each inner conductor is connected to an external strip line.

2. A strip line type circulator according to claim 1 in which each inner conductor is of radial shape.

3. A strip line type circulator according to claim 1, wherein said predetermined angle is in the range between 15° and 25°.

4. A strip line type circulator according to claim 1, wherein the arms of each inner conductor are intersected with one another.

* * * * *